US011661751B2

(12) United States Patent
Marcil et al.

(10) Patent No.: US 11,661,751 B2
(45) Date of Patent: May 30, 2023

(54) MOISTURE BARRIER MOLDING TO REDUCE WATER DAMAGE ON WALLS

(71) Applicants: Sebastien Marcil, Gatineau (CA); Alain Marcil, Casselman (CA)

(72) Inventors: Sebastien Marcil, Gatineau (CA); Alain Marcil, Casselman (CA)

( * ) Notice: Subject to any disclaimer, the term of this patent is extended or adjusted under 35 U.S.C. 154(b) by 7 days.

(21) Appl. No.: 17/217,850

(22) Filed: Mar. 30, 2021

(65) Prior Publication Data

US 2021/0324639 A1 Oct. 21, 2021

(30) Foreign Application Priority Data

Apr. 20, 2020 (GB) ..... 2005744

(51) Int. Cl.
*E04F 19/04* (2006.01)
*E04B 1/66* (2006.01)

(52) U.S. Cl.
CPC ..... *E04F 19/045* (2013.01); *E04B 1/665* (2013.01)

(58) Field of Classification Search
CPC ..... E04B 1/66; E04B 1/665; E04F 19/0436; E04F 2019/0445; E04F 19/045
USPC ..... 52/396.02, 396.03, 396.04, 396.07
See application file for complete search history.

(56) References Cited

U.S. PATENT DOCUMENTS 1,555,392 A * 9/1925 Tracy ..... E04F 19/04 52/287.1
2,679,156 A * 5/1954 McFarland ..... E04F 13/04 52/454
3,192,577 A * 7/1965 Barr ..... E04B 1/6803 52/364
3,245,224 A 4/1966 Wilkinson
4,364,212 A * 12/1982 Pearson ..... E04B 2/7863 52/481.1
4,825,612 A * 5/1989 Tupman ..... E04F 19/062 52/464
5,349,799 A 9/1994 Schiedegger
5,487,701 A 6/1996 Schiedegger et al.
5,976,009 A 11/1999 Achen
D492,401 S 6/2004 Achen
D493,880 S 8/2004 Achen
D494,669 S 8/2004 Achen
D507,048 S 7/2005 Achen
D576,723 S 9/2008 Achen
D582,029 S 12/2008 Achen
7,634,883 B1 * 12/2009 Larson ..... E04F 13/06 52/573.1
D621,924 S 8/2010 Achen
7,909,686 B2 3/2011 Achen
D864,424 S * 10/2019 Filiba ..... D25/153
2006/0150553 A1 * 7/2006 Reyes ..... E04F 13/06 52/393
2007/0130861 A1 * 6/2007 Chenier ..... E04F 13/06 52/371

(Continued)

*Primary Examiner* — William V Gilbert

(57) ABSTRACT

A moisture barrier molding having a divider portion and a pair of attachment surfaces extending laterally and generally perpendicularly from both sides of the divider portion. One of the attachment surface having a plurality of aeration holes; each aeration hole having a tab extending perpendicularly therefrom so as to create a plurality of tabs which are placed on top of a baseboard so as to create a gap between the baseboard and the divider portion so as to allow air to pass through the aeration holes.

5 Claims, 4 Drawing Sheets

(56) References Cited

U.S. PATENT DOCUMENTS

| | | | |
|---|---|---|---|
| 2008/0236062 | A1 | 10/2008 | Achen |
| 2011/0225912 | A1 | 9/2011 | Achen |

* cited by examiner

MOISTURE BARRIER MOLDING TO REDUCE WATER DAMAGE ON WALLS

CROSS-REFERENCE TO RELATED APPLICATIONS

The present application claims priority to UK Request number 2005744.4, filed on Apr. 20, 2020 entitled "Moisture barrier molding to reduce water damage on walls", the disclosure of which is hereby incorporated in its entirety at least by reference.

BACKGROUND OF THE INVENTION

1. Field of the Invention

The present invention relates generally to walls but more particularly to a moisture barrier molding to reduce water damage on walls.

2. Description of Related Art

Damage to walls caused by water, such as in the case of a flood, can be costly and time consuming to repair. This is especially true in the case of gypsum wall since gypsum does not take water very well. Wet gypsum causes black mold to grow inside wall cavities, causing health problems to certain individuals. Typically, after a flood, a specially trained team of workers comes and cuts the gypsum walls to two feet above the floor and fans move the air so as to dispel the moisture. This causes unnecessary construction work and stress to the occupants. Once moisture is brought to ambient level and no molds have formed on the walls (both outside and inside), it is time to put new gypsum on the bottom two feet. There has to be a faster more economical way of solving this situation.

BRIEF SUMMARY OF THE INVENTION

It is a main object of the present disclosure to provide for a moisture barrier molding to reduce water damage on walls.

In order to do so, there is provided a moisture barrier molding for use in combination with wall panels having a pair of two attachment surfaces extending laterally and generally perpendicularly from a divider member the divider member having an upward side upon which rest the wall panels, and a downward side. Extending perpendicularly from the upward side is a top portion of one of the two attachment surfaces and a bottom portion of the other of the two attachment surfaces. The divider portion has: the moisture barrier being installed perpendicularly to vertical wall studs such that the divider portion lies parallel and above a floor surface in such a way that a baseboard running atop the floor surface runs under the divider portion at a distance from the divider portion determined by a plurality of tabs extending perpendicularly from the bottom side such that the baseboard makes contact under the plurality of abs and a void is thus created between the plurality of tabs and the downward side of the divider portion. The plurality of tabs, is folded outwardly from the bottom side of one of the two attachment surfaces creates openings in the bottom side which serves as a plurality of aeration holes for allowing air to pass through the plurality of holes so as to provide ventilation within the wall so as the control humidity level.

The moisture barrier molding is made out of cold formed galvanized steel or of extruded polymer resin.

Mechanical fasteners can be driven through the moisture barrier molding so that the moisture barrier can be fixedly attached to the wall studs.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein.

Figures 1A, 1B:
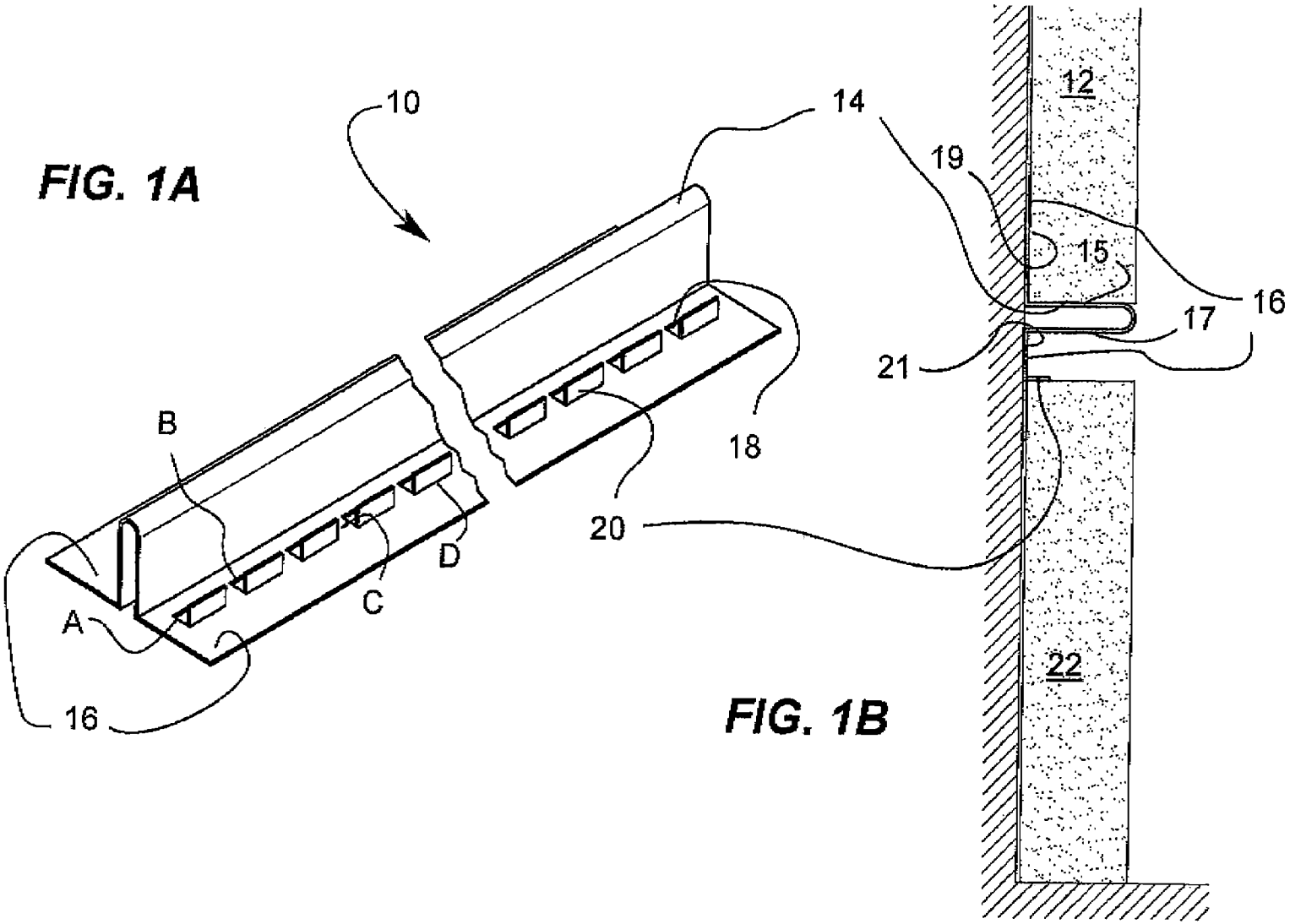
FIG. 1A is an isometric view of a moisture barrier molding in context of use, according to an embodiment of the present invention.
FIG. 1B is a side view detail of the moisture barrier molding in context of use, according to an embodiment of the present invention.

Referring now to any of FIGS. 1A-B, there is provided a moisture barrier molding (10) for use with wall panels (12) such as, but not limited to, gypsum panels. The molding (10) is comprised of a pair of two attachment surfaces (16) extending laterally and generally perpendicularly from a divider member (14) the divider member (14) having an upward side (15) upon which rest the wall panels (12), and a downward side (17). Extending perpendicularly from the upward side (15) is a top portion (19) of one of the two attachment surfaces (16) and a bottom portion (21) of the other of the two attachment surfaces (16).

The moisture barrier molding (10) can be made of cold formed galvanized steel or aluminum or extruded metal or polymer resin.

The divider member (14) has: the moisture barrier being installed substantially perpendicularly to substantially vertical wall studs such that the divider portion lies substantially parallel and above a floor surface in such a way that a baseboard running atop the floor surface runs under the divider portion at a distance from the divider portion determined by a plurality of tabs extending perpendicularly from the bottom side such that the baseboard makes contact under the plurality of tabs and a void is thus created between the plurality of tabs and the downward side of the divider portion.

The plurality of tabs, being folded outwardly from the bottom side of one of the two attachment surfaces creates openings in the bottom side which serves as a plurality of aeration holes for allowing air to pass through the plurality of holes so as to provide ventilation within the wall so as the control humidity level.

Each of the plurality of aeration holes (18) has a co-joined tab (20) extending perpendicularly therefrom. The plurality of tabs (20) is created during the manufacturing process of the molding (10) by cutting on three sides (A, B, C) so as to keep a fourth side (D) attached to the attachment surface (16) so that by pivoting the resulting partially detached piece creates the plurality of tabs (20). After a baseboard (22) is put in place, the moisture barrier (10) is installed by having the plurality of tabs (20), which are generally set perpendicularly relative to the pair of attachment surfaces (16), rest on top of the baseboard (22) so as to create a gap (21) between the baseboard (22) and the divider member (14) so as to allow air to pass through the aeration holes (18).

Figure 4:
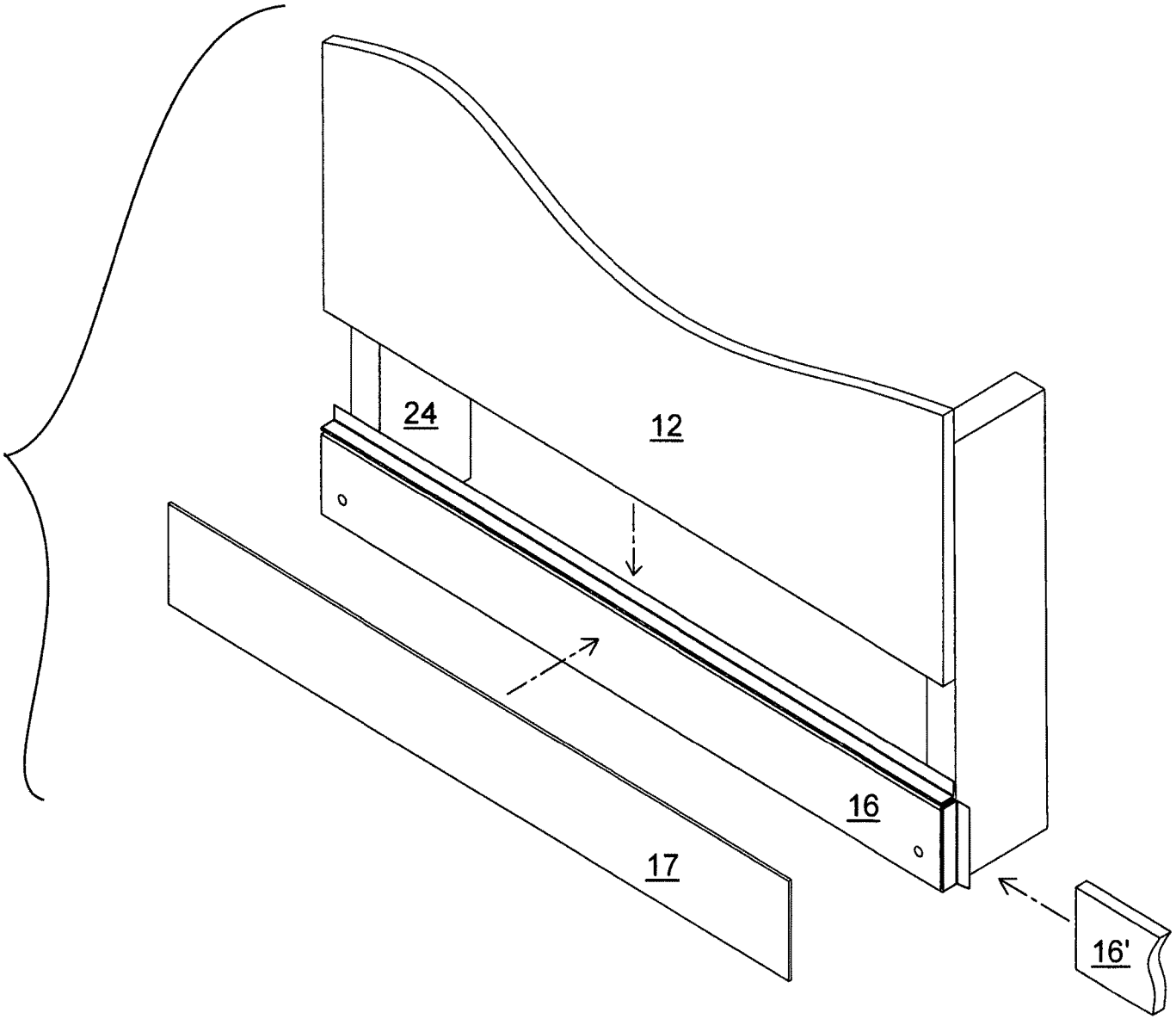
FIG. 4 is an exploded view showing a baseboard cover about to be installed over a baseboard, and the wall panel also about to be installed.

The molding (10) is designed so that mechanical fasteners (not shown) can be driven through it so that it can be fixedly attached to wall studs (24). Also, as shown in FIG. 4, the molding (10) can be cut longer than the baseboard (22), with its attachment surfaces (16) trimmed so that the molding (10) can be folded and the plurality of tabs (20) flattened so as to serve as an interface with the next section of baseboard (22'). A decorative baseboard cover (26) can be used to hide the gaps and the molding (10).

Figure 2B:
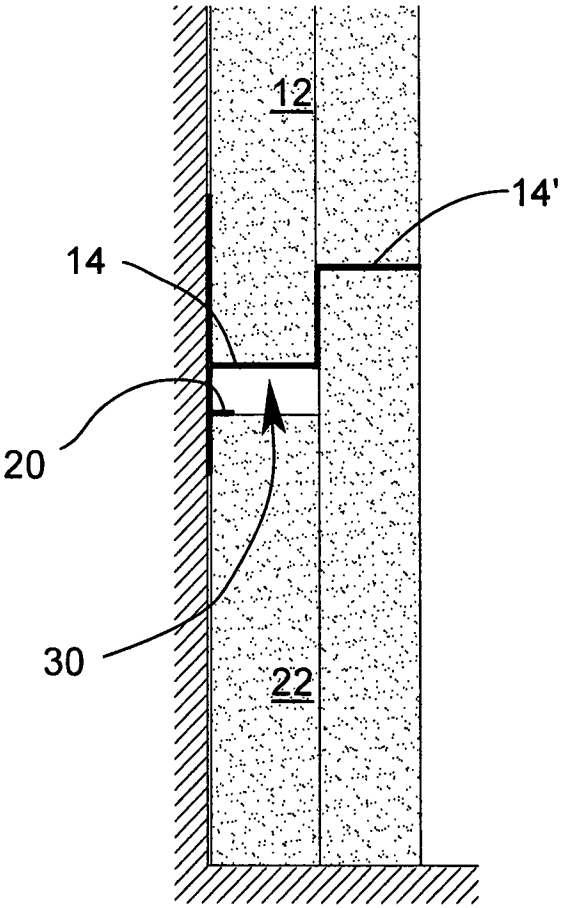
FIG. 2B is a side view detail of the double moisture barrier molding according to an embodiment of the present invention.
Figure 2A:
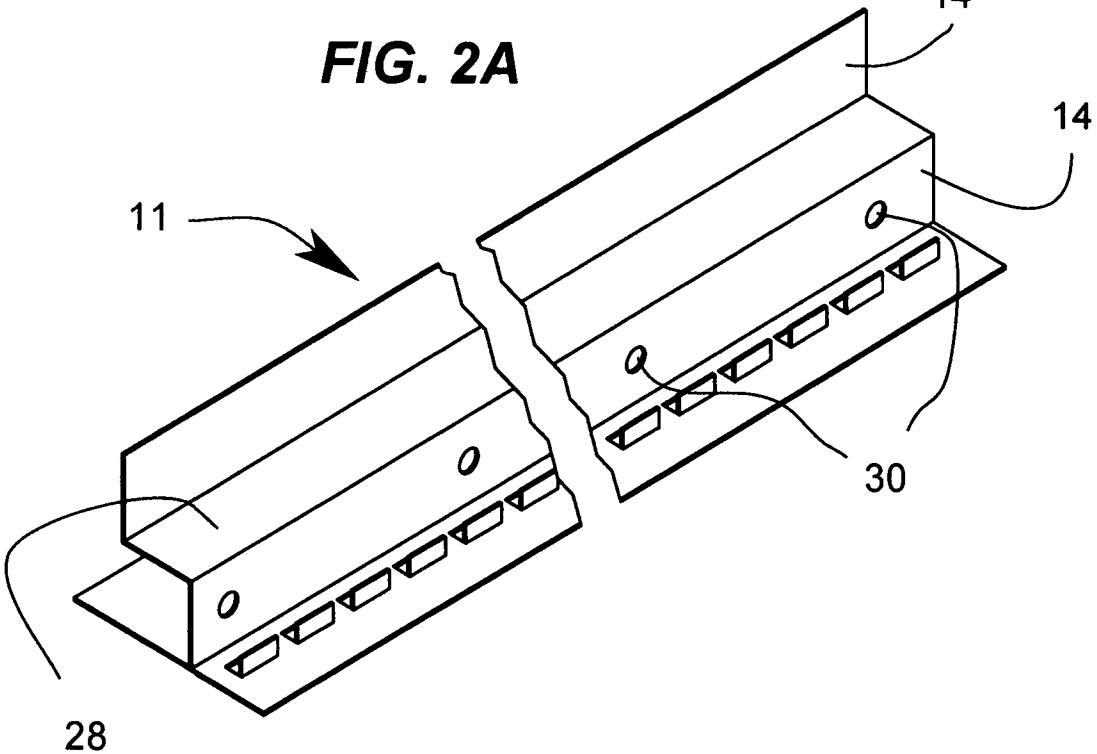
FIG. 2A is an isometric view of the double moisture barrier molding according to an embodiment of the present invention.
Figure 3B:
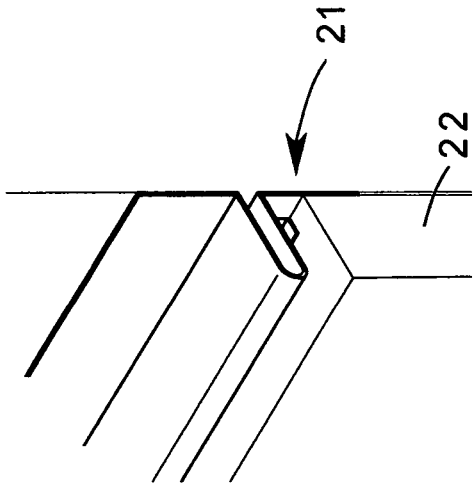
FIG. 3B is a side view detail of the moisture barrier before installing the wall panel, according to an embodiment of the present invention.
Figure 3A:
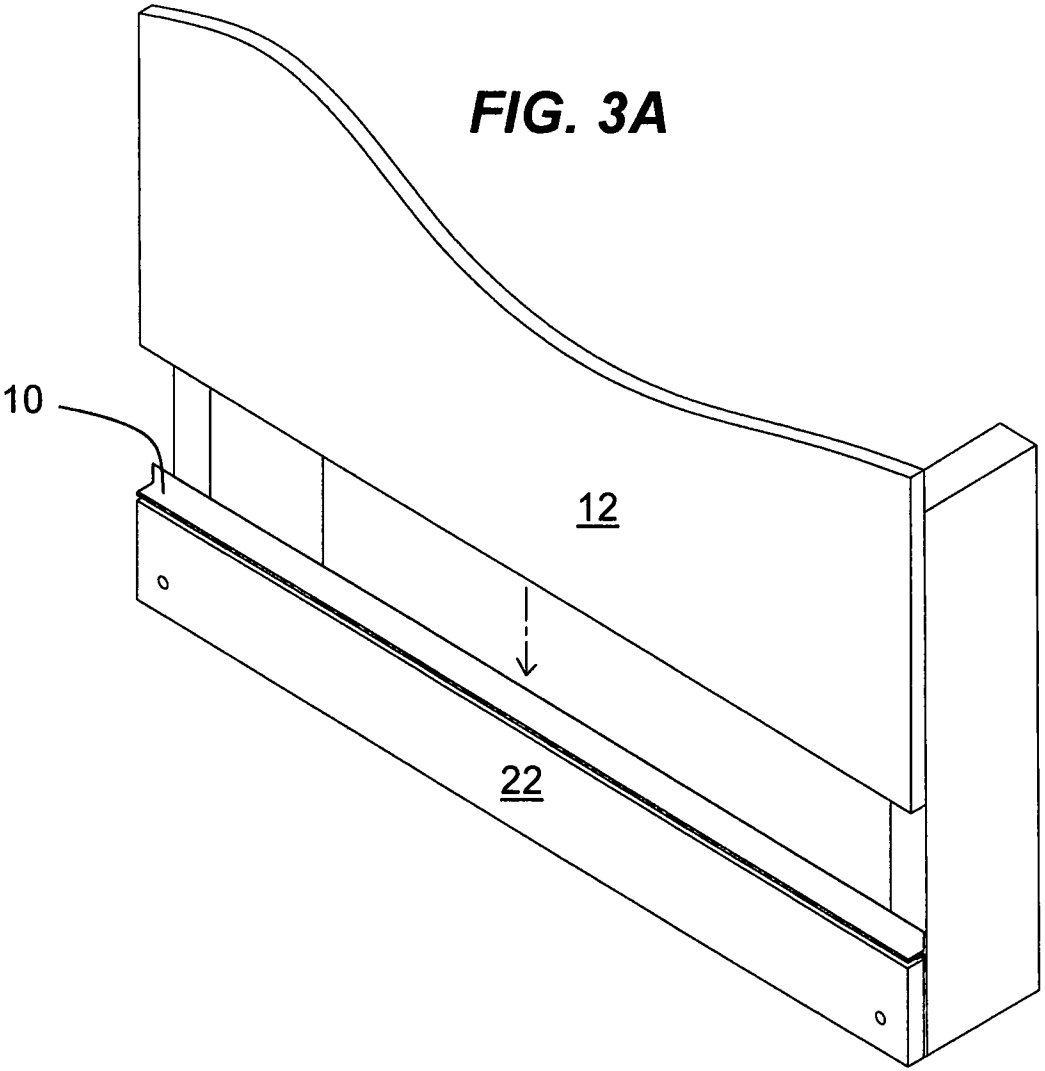
FIG. 3A is an isometric view of the process of installing a wall panel over the molding, according to an embodiment of the present invention.

According to a second embodiment, as best seen in FIGS. 2A-B, there is provided a double moisture barrier molding (11) which has two divider portions (14, 14'), and each is connected to the other by way of a perpendicularly aligned connector (28) relative to both the first and the second divider portions (14, 14') so as to connect them together. With the double moisture barrier molding (11) a two layer thickness of panels (12) can be used when there is a need for fire rated walls. The stepped configuration gives the layers of panels (12) a staggered configuration. Also, the first divider portion (14) which extends directly from the attachment surfaces (16) has a plurality of drain holes (30) to facilitate the drying and aeration process.

Whether using the moisture barrier molding (10) or the double moisture barrier molding (11), both allows for the use of the baseboard (22) of an appropriate thickness for the needs.

When installing the panels (12) over studs (24), the baseboard (22) is installed first, then the moisture barrier molding (10, 11) is securely placed on top of the baseboard such that the tab touch the top of the baseboard so as to leave a gap between the top of the baseboard and the divider portion (14). After that, one or more panels (12) can be installed on top of the divider portion. Typically, the panels (12) are cut and felled pieces become the baseboard members (22), which are then covered by the baseboard cover (26).

In the event of a flood, once the water is extracted, the baseboard members (22) can easily be removed without damaging the main pieces of panels (12) above, and allows for the removal of wet insulation and the disinfection of wall cavities. When the baseboard members (22) are removed, it accelerates the drying process of the wall cavities, preventing mold growth and limiting construction material disposal. The moisture barrier (10) prevents flood water from creeping up by capillary action. Once humidity level is back to normal, the baseboard members (22) whether the same or replacement, can be put back to close the wall, and aeration can continue inside the wall cavity by way of the aeration holes (18).

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A moisture barrier molding for use in combination with a plurality of wall panels comprising:

a first attachment surface and a second attachment surface, each of the attachment surfaces extending laterally and generally perpendicularly from a divider member;

the divider member having a first side upon which rests a first one of the wall panels, and a second side opposite the first side, the first attachment surface extending from the first side of the divider member and the second attachment surface extending from the second side of the divider member;

a plurality of tabs, each of the tabs formed by having three sides cut from the second attachment surface, each of the tabs having a fourth side connected to the second attachment surface, each of the tabs being bent about the fourth side and extending perpendicular to the second attachment surface so as to form an aeriation hole extending through a thickness of the second attachment surface, each of the tabs having a lower surface and an upper surface opposite the lower surface;

the moisture barrier being installed substantially perpendicular to a longitudinal axis of a plurality of wall studs such that the divider portion lies substantially parallel and above a floor surface wherein a baseboard placed atop the floor surface abuts the lower surfaces of the tabs, and a space is provided between the upper surface of the tabs and the lower surface of the divider, and the aeration holes are between the upper surface of the tabs and the divider.

2. The moisture barrier molding of claim 1 wherein the moisture barrier molding is made out of cold formed galvanized steel.

3. The moisture barrier molding of claim 2 wherein mechanical fasteners can be driven through the moisture barrier molding so that the moisture barrier can be fixedly attached to the wall studs.

4. The moisture barrier molding of claim 1 wherein the moisture barrier molding is made out of extruded polymer resin.

5. The moisture barrier molding of claim 4 wherein mechanical fasteners can be driven through the moisture barrier molding so that the moisture barrier can be fixedly attached to the wall studs.

* * * * *